US012723500B2

(12) United States Patent
Butler et al.

(10) Patent No.: US 12,723,500 B2
(45) Date of Patent: Sep. 1, 2026

(54) DOWNHOLE FLUID SEPARATOR IN LATERAL OF RE-ENTRY MULTILATERAL WELL

(71) Applicant: Halliburton Energy Services, Inc., Houston, TX (US)

(72) Inventors: Benjamin Luke Butler, Dubai (AE); Muhammad Arra'uf Abdul Shukor, Dhahran (SA); Micah Janzen, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/812,781

(22) Filed: Aug. 22, 2024

(65) Prior Publication Data

US 2025/0067161 A1 Feb. 27, 2025

Related U.S. Application Data

(60) Provisional application No. 63/534,794, filed on Aug. 25, 2023.

(51) Int. Cl.

| | |
|---|---|
| ***E21B 43/38*** | (2006.01) |
| ***E21B 41/00*** | (2006.01) |
| ***E21B 43/12*** | (2006.01) |

(52) U.S. Cl.

CPC ..... *E21B 43/385* (2013.01); *E21B 41/0035* (2013.01); *E21B 41/0042* (2013.01); *E21B 43/128* (2013.01)

(58) Field of Classification Search

None

See application file for complete search history.

(56) References Cited

U.S. PATENT DOCUMENTS

| | | | | |
|---|---|---|---|---|
| 5,762,149 | A * | 6/1998 | Donovan | E21B 43/305 166/313 |
| 5,868,210 | A * | 2/1999 | Johnson | E21B 41/02 166/50 |
| 5,959,547 | A * | 9/1999 | Tubel | E21B 47/107 340/853.2 |
| 6,056,054 | A | 5/2000 | Brady et al. | |
| 6,167,965 | B1 * | 1/2001 | Bearden | E21B 47/0175 417/18 |

(Continued)

OTHER PUBLICATIONS

International Search Report and Written Opinion for International Patent Application No. PCT/US2024/043579 dated Dec. 3, 2024. PDF file. 9 pages.

*Primary Examiner* — Blake Michener

(74) *Attorney, Agent, or Firm* — Scott Richardson; C. Tumey Law Group PLLC

(57) ABSTRACT

A system may include a fluid separator disposed within a lateral bore of a multilateral well. The fluid separator may be configured to receive formation fluid from a main bore of the multilateral well, separate the formation fluid into formation water and production fluid, and output the production fluid to flow uphole. The system may also include a lower lateral packer, disposed within the lateral bore in a position downhole from the fluid separator, and a downhole pump disposed in the lateral bore. The downhole pump is configured to receive the formation water from the fluid separator and pump the formation water to flow into a portion of the lateral bore downhole from the lower lateral packer.

20 Claims, 4 Drawing Sheets

(56) References Cited

U.S. PATENT DOCUMENTS

| | | | | |
|---|---|---|---|---|
| 6,213,208 | B1 * | 4/2001 | Skilbeck | E21B 43/40 166/105.1 |
| 6,279,651 | B1 * | 8/2001 | Schwendemann | E21B 41/0035 166/54.1 |
| 6,923,259 | B2 * | 8/2005 | Snow | E21B 43/40 166/265 |
| 7,159,661 | B2 * | 1/2007 | Restarick | E21B 41/0042 166/117.6 |
| 10,378,328 | B2 * | 8/2019 | Saponja | E21B 43/12 |
| 10,583,373 | B2 | 3/2020 | Braaten et al. | |
| 11,913,322 | B1 * | 2/2024 | Aleid | E21B 41/0035 |
| 2001/0017207 | A1 | 8/2001 | Haheim | |
| 2005/0121190 | A1 * | 6/2005 | Oberkircher | E21B 41/0035 166/250.1 |
| 2010/0218944 | A1 | 9/2010 | Quigley et al. | |
| 2011/0079388 | A1 | 4/2011 | Cox | |
| 2018/0154282 | A1 | 6/2018 | Braaten et al. | |
| 2019/0186222 | A1 * | 6/2019 | Steele | E21B 41/0035 |
| 2022/0251926 | A1 | 8/2022 | Almajid et al. | |
| 2023/0066633 | A1 * | 3/2023 | Trisal | E21B 43/08 |

* cited by examiner

DOWNHOLE FLUID SEPARATOR IN LATERAL OF RE-ENTRY MULTILATERAL WELL

CROSS-REFERENCE TO RELATED APPLICATIONS

The present application is a non-provisional conversion of U.S. Provisional Application Ser. No. 63/534,794, filed Aug. 25, 2023, the entire disclosure of which is incorporated herein by reference.

BACKGROUND

Oil and gas wells produce significant amounts of water in their lifetime. The percentage of water produced from these wells is called the water cut, the ratio of the water produced from the well compared to the volume of the total liquids produced. Most wells produce an ever-increasing water cut throughout their productive life. In many oil fields around the world the percentage of water recovered with oil has risen to be greater than the percentage of the oil. In fact, in many fields, the percentage of oil has decreased to be from about 20% in an excellent field to about 2% in a relatively poor field.

The end of a well's productive life is often determined by the water cut. A well is typically shut in when the value of the hydrocarbons produced is no longer sufficient to economically cover the operating costs of the well and the cost of disposing of the produced water. Indeed, disposing of the produced water is not environmentally and economically friendly as energy is used to power the pump to lift the produced water to the surface, to separate the produced water from the oil, to transport the separated water as it cannot be disposed on the surface in most cases. Thus, the separated water must be transported to a remote well site to be reinjected into a subterranean formation. Therefore, decreasing the water cut of a well increases the value of the produced fluids and directly decreases the disposal costs of the produced water.

One method of reducing the water cut of a well is to separate produced water from the hydrocarbons downhole, rather than at surface. Downhole separation increases the value of the fluids produced to the surface. Downhole separation also facilitates disposal of the separated water. The separated water can be reinjected into the same production zone or into a different zone. Another way to improve the productivity of a well is to increase the length of the intersection of the productive zone by the well completion. One way of increasing this intersection length is by using multilateral wells. A multilateral well is a conventional well that has a lateral well that is drilled from a point in the original well. The lateral well increases productivity by allowing additional intersection length along the productive zone without the cost and delay involved in re-drilling the upper part of the well. While multilaterals enable multiple intersections within the same productive zone, multilaterals also enable fluid communication with different productive zones within a reservoir. In certain reservoirs, operators can leverage this approach to improve reservoir production by accessing numerous production zones or by increasing the contact area between a wellbore and a formation with minimal increase in drilling and completion costs. These techniques also reduce the environmental footprint of drilling rigs and subsequent production trees, particularly for land operations. Therefore, the use of multilaterals increases the potential production of a well and can also enable disposal of the produced water in a different zone.

BRIEF DESCRIPTION OF THE DRAWINGS

These drawings illustrate certain aspects of some examples of the present disclosure and should not be used to limit or define the disclosure.

DETAILED DESCRIPTION

Figure 1:
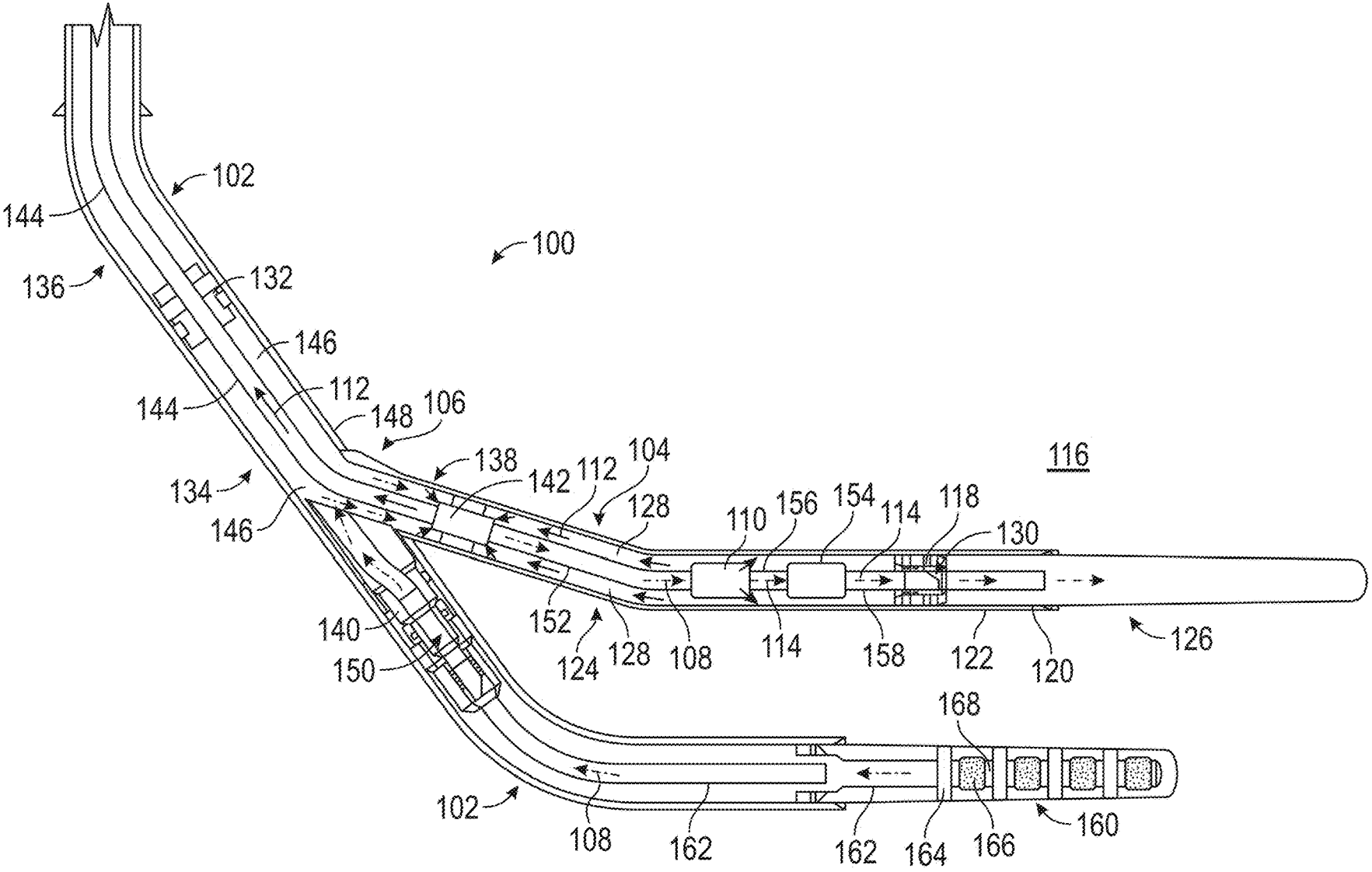
FIG. 1 illustrates a downhole assembly with a fluid separator disposed in a lateral bore of a multilateral well, in accordance with some embodiments of the present disclosure.

The present disclosure relates to the field of downhole fluid separator. More specifically, systems are described of multilateral well completion design to install fluid separator on the upper completion and inside a lateral well and methods of use thereof. A fluid separator includes an oil/water separator and a gas/oil/water separator, for example. Fluid separators that are installed downhole in multilateral oil wells can require that they are placed in long tangent sections within a wellbore, above the multilateral junction. However, the cost associated with the planning and implementation of a novel multilateral well is significant. In fact, the cost to design and install a downhole fluid separator with a tangent section may be as high as the cost of the entire multilateral well without the separator. In addition, the placement of the fluid separator above the multilateral junction requires installing it right from the onset when completing the well to minimize the risk of losing the well. In embodiments, the fluid separator can be placed in a lateral well instead of above the multilateral oil wells. This simplifies the installation. This reduced complexity allows the fluid separator according to embodiments of the present disclosure to be installed into existing wells, i.e., retrofitting existing wells. Further, the lateral well can be a target formation. The existing wells do not require a tangent section at the junction for the separator placement, increasing significantly the number of oil well candidates for installation of the fluid separator according to embodiments of the present disclosure.

The design of the installed completion equipment is critical for the downhole fluid separator to function as intended. Current well designs place the downhole fluid separator above the multilateral junction. By installing the fluid separator according to embodiments of the present disclosure in one of the lateral wells, an existing watered out well can be re-entered, a new lateral added to it, and the separator installed within. This decreases the overall cost involved in installing the fluid separator according to embodiments of the present disclosure as compared with installing it at the completion of the well at the beginning of the life of the well. It also decreases the risks associated with installing downhole fluid separator according to embodiments of the present disclosure as existing wells that are already poor producers can be selected as candidates and represent a smaller cost if the well is lost during the trial as compared with selecting a potential well before well completion is finished. Using a fluid separator in a downhole setting combined with a multilateral junction provides efficiency gains. This includes converting poor performing wells, wherein the percentage of oil has decreased to about 2% for example, into a downhole water injector combined with a better producing well. Conversely, a poor performing well may also benefit from the addition of a lateral well which would be the downhole water injector. This would enable additional oil to be produced to surface. Additional benefits include lower flow rate and pressure rating requirements, a lighter fluid column, and increased recovery. The fluid separator according to embodiments of the present disclosure may be particularly useful in low flow rate wells (in the 200 barrel per day range or less), which tend to be shallow, and relatively inexpensive to drill. Moderate flow rate wells, for example 500-5000 barrels of fluid per day, can also be potential candidates for the downhole fluid separator according to embodiments of the present disclosure. Finally, it will also be useful for most multilaterals with very high flow rate wells, up to 50,000 barrels of fluid per day, for example.

Multilateral wells are characterized according to definitions established in 1997 during a Technology Advancement of Multilaterals (TAML) Forum held in Aberdeen. These standards classify junctions as TAML Level 1, 2, 3, 4, 5, or 6 based on mechanical complexity, connectivity, and hydraulic isolation. The ascending order of these levels reflects increasing mechanical and pressure capability of the junction. Consequently, cost, complexity, and risk also generally increase at the higher TAML levels. However, other considerations of the well design also influence the overall complexity of the well—for example, a TAML Level 2 well with an advanced intelligent completion can be more complex and costly than a TAML Level 5 well with a simpler completion system.

In a TAML 1 well, the main bore, lateral, and junction are uncased. This basic lateral is designed to enhance reservoir drainage from consolidated formations. It has the advantage of low drilling and completion costs, but the open hole junction makes reentry into the lateral wellbore and control of flow from the lateral impossible.

Wells that have cased and cemented main bores and open hole laterals are designated TAML Level 2. A cemented main bore significantly reduces the risk of wellbore collapse and provides isolation between laterals. By placing sliding sleeves and packers in the main bore, operators can produce the bores singly or commingle production.

Placing a liner in the lateral and mechanically connecting it to the cased and cemented main bore results in a TAML Level 3 well. A liner is a string of casing that does not extend to the surface but is anchored or suspended inside a previously run casing string. This TAML Level 3 well includes a lateral that is cased but not cemented at the junction. It is a relatively low-cost option that includes reentry capabilities and a lateral that is better supported than that of Levels 1 and 2. Using sliding sleeves and packer plugs, operators can produce the bores singly or commingle production. A TAML Level 3 junction does not provide hydraulic isolation, and its use is restricted to consolidated formations.

TAML Level 4 junctions are applicable in both consolidated and unconsolidated formations because both the lateral and the main bore are cased and cemented at the junction. The junction provides full-bore access to the lateral, and mechanical support is supplied by the tubulars and cement. However, because the cement can only withstand limited differential pressure, the junction does not provide hydraulic isolation.

TAML Level 5 wells do provide hydraulic isolation at the junction because pressure integrity is provided by the completion, which includes production tubing connecting a packer in the main wellbore above the junction and a packer in the lateral wellbore. Because hydraulic isolation and support are provided by the completion hardware, the junction may be a TAML Level 2, 3, or 4 before the Level 5 completion is installed.

TAML Level 6 wells also provide hydraulic isolation at the junction. A well at this level differs from a TAML Level 5 well in that pressure integrity is provided by the main wellbore casing and a cemented or uncemented liner in the lateral. The cost and complexity of creating a single-metal-element dual-bore casing junction downhole has prevented TAML Level 6 wells from being developed. As of today, the category exists as a result of early experiments. Because multilateral wells that have higher TAML designations are generally more complex, they are more costly, and their configurations are more flexible. As they do with multilateral geometry, engineers choose a TAML level junction based primarily on reservoir characteristics, costs, and function.

The ability to reenter the lateral for well intervention operations is another multilateral well design consideration. Because it is a directionally drilled section that has no junction, the lower lateral is almost always easily accessed using standard intervention methods. Operators must make an economics-based decision during the well planning stage to include junctions that allow lateral access after pulling upper completion, through-tubing access, junctions that can be adopted to allow access after installation or junctions through which no access is possible to main bore, lateral, or both. If the well includes more than one lateral, a selective through-tubing access system would need to be considered. The decision to deploy lateral junctions that allow full-bore or restricted access is a function of the overall well design. Engineers usually opt for full-bore access if a packer is to be placed below the junction or if an artificial lift system must be located near the lower lateral. In addition, based on their knowledge of the reservoir, operators may require full-bore access to perform perforating, stimulation, logging, water shutoff, gravel packing, cleanout, and other remedial operations. Full-bore access can be adapted to all TAML level junctions but must be specified before installation; some commercially available junctions allow no access or only restricted access to either the lateral or the main bore and cannot be adapted after installation.

The decision to use a multilateral well system and what type to use are the result of cost-benefit analyses. In general, the less-complex junctions present operators with lower risks and costs. But risk mitigation and cost savings must be balanced against individual well and field development expectations. In low-value reservoirs, a simple open hole lateral that has no reentry capability may increase ultimate reserve recovery or accelerate production while having little impact on overall drilling and completion costs. In high-value deepwater plays, installing a hydraulically sealed TAML Level 5 or 6 junction can drive total well costs into millions of dollars and still be a good investment because it may save drilling another well with a complex and tortuous trajectory, preserve a well slot on an existing production platform, or eliminate the need entirely to procure and install additional subsea infrastructure.

In embodiments, a multilateral well is drilled and completed with a TAML Level 4 junction. The lower completion including the whipstock in the main bore and lateral liner are cemented. The upper completion includes a pump, a fluid separator, a crossflow packer, and a production packer. The pump, the fluid separator, the crossflow packer, and the production packer are in the lateral well according to embodiments of the present disclosure. The production packer can be above the junction between the lateral well and the main bore in some embodiments or below the junction in other embodiments. The production packer may be any packer capable of providing a seal between the outside of the production tubing and the inside of the casing. The pump includes any pump capable of drawing in the formation fluid through the pump intake, pressurizing it, and lifting it to the surface such as an electrical submersible pump. The crossflow packer includes any sealing device capable of directing the formation fluid from the main bore to the separator located in the lateral well and directing the oil from the separator to the surface.

FIG. 1 illustrates a downhole assembly with a fluid separator disposed in a lateral bore of a multilateral well, in accordance with some embodiments of the present disclosure. As illustrated, the multilateral well 100 may include a Technology Advancement of Multilaterals (TAML) level 4 on a new well without re-entry packer. However, the multilateral well 100 may include any suitable type of multilateral well and completion. As illustrated, the multilateral well 100 may include a main bore 102 and at least one lateral bore 104. Moreover, as illustrated, the lateral bore 104 may deviate from the main bore 102 at a junction 106. The main bore 102 may produce formation fluid 108, which may include oil and water. Alternatively, the formation fluid 108 may include oil, gas, and water.

A fluid separator 110 may be disposed within a lateral bore 104 of the multilateral well 100. As illustrated, the fluid separator 110 may be configured to separate the formation fluid 108 (e.g., oil, gas, and/or water) into production fluid 112 (e.g., formation oil and/or formation gas) and formation water 114. For example, the formation fluid 108 may include oil, gas, and water such that the formation fluid 108 may be configured to separate the formation fluid 108 into formation oil, formation gas, and the formation water 114. Alternatively, the formation fluid 108 may include oil and water such that the formation fluid 108 may be configured to separate the formation fluid 108 into formation oil and the formation water 114. Further, the formation fluid 108 may include gas and water such that the formation fluid 108 may be configured to separate the formation fluid 108 into formation gas and the formation water 114.

Moreover, as illustrated, the fluid separator 110 is configured to receive the formation fluid 108 produced from a main bore 102 of the multilateral well 100 and separate the formation fluid 108 into the formation water 114 and the production fluid 112. Generally, the fluid separator 110 is configured to output the production fluid 112 to flow uphole toward the surface of production operations and output the formation water 114 to flow into a portion of the lateral bore 104 disposed downhole from the fluid separator 110 such that the formation water 114 may flow into the lateral bore 104 and a formation 116 around the lateral bore 104.

A lower lateral packer 118 may be disposed within the lateral bore 104 in a position downhole from the fluid separator 110. The lower lateral packer 118 may include any suitable type of production packer. Further, the lower lateral packer 118 may be configured to seal against a lateral bore casing 120 or wellbore wall 122 of the lateral bore 104 to isolate a separator portion 124 of the lateral bore 104 from a lower portion 126 of the lateral bore 104. In particular, the lower lateral packer 118 may be configured to isolate a separator annulus 128 of the separator portion 124 from the lower portion 126 of the lateral bore 104. Moreover, as illustrated, the fluid separator 110 may be disposed within the separator portion 124 of the lateral bore 104. The formation water 114 output from the fluid separator 110 may be directed to flow through a central bore 130 of the lower lateral packer 118 and into the lower portion 126 of the lateral bore 104.

An upper main bore packer 132 may be disposed in the main bore 102 in a position uphole from a junction 106 between the main bore 102 and the lateral bore 104. As set forth in greater detail below, the upper main bore packer 132 may be configured to isolate a junction portion 134 of the multilateral well 100 from an upper portion 136 of the main bore 102. As illustrated, the junction portion 134 may include an upper portion 138 of the lateral bore 104, as well as a portion of the main bore 102 disposed between a completion deflector 140 and the upper main bore packer 132.

Additionally, a crossflow packer 142 may be disposed within the lateral bore 104 in a position uphole from the fluid separator 110. The crossflow packer 142 may be configured to isolate the separator portion 124 of the lateral bore 104 from the upper portion 138 of the lateral bore 104. Indeed, the crossflow packer 142 may isolate the separator portion 124 of the lateral bore 104 from the junction portion 134 of the multilateral well 100. Moreover, as illustrated, an upper production tubing 144 may extend from the crossflow packer 142 and to the upper main bore packer 132. The upper production tubing 144 may further extend through the upper main bore packer 132 toward the surface. Having the upper production tubing 144 extending between the crossflow packer 142 and the upper main bore packer 132 may form an upper annulus 146 between the upper production tubing 144 and a casing 148 and/or wellbore wall 122 in the junction portion 134 of the multilateral well 100. As illustrated, the upper annulus 146 may extend from the from the crossflow packer 142 to the upper main bore packer 132. That is, a downhole end of the upper annulus 146 may be sealed from the separator annulus 128 via the crossflow packer 142, and an uphole end of the upper annulus 146 may be sealed from the upper portion 136 of the main bore 102 via the upper main bore packer 132.

As set forth above, the formation fluid 108 produced in the main bore 102 may be directed toward the fluid separator 110. Specifically, the formation fluid 108 may flow into the upper annulus 146 of the junction portion 134 from a central bore 150 of the completion deflector 140, which may be disposed in the main bore 102 in a position downhole from the junction 106. As set forth above, the upper annulus 146 may be sealed by the upper main bore packer 132 and the crossflow packer 142. However, the crossflow packer 142 may include an uphole inlet (shown in FIG. 2) in fluid communication with the upper annulus 146. The formation fluid 108 flowing into the upper annulus 146 from the main bore 102 may flow into the crossflow packer 142 via the uphole inlet. Further, as set forth in greater detail below, the crossflow packer 142 may be configured to output the formation fluid 108, via a downhole outlet (shown in FIG. 2), into a connection tubing 152 extending from the crossflow packer 142 to the fluid separator 110.

The connection tubing 152 may be disposed in the separator portion 124 of the lateral bore 104. Moreover, a separator annulus 128 may be formed in the separator portion 124 of the lateral bore 104 between various tubulars and/or downhole tools and the lateral bore casing and/or the wellbore wall of the lateral bore 104. For example, the separator annulus 128 may be formed between a surface of the lateral bore casing 120 and radially outer surfaces of the connection tubing 152, the fluid separator 110, a downhole pump 154, a fluid conduit 156 (e.g., tubing) extending between the fluid separator 110 and the downhole pump 154, a lower tubing 158 extending from the downhole pump 154 to the lower lateral packer 118, or some combination thereof. Further, the crossflow packer 142 and the lower lateral packer 118 may be configured to seal upper and lower ends of the separator annulus 128, respectively.

Moreover, as set forth above, the fluid separator 110 is configured to separate the formation fluid 108 into the formation water 114 and the production fluid 112. That is, the formation fluid 108 flowing into the fluid separator 110 from the crossflow packer 142, via the connection tubing 152, may be separated into the formation water 114 and the production fluid 112. As illustrated, the fluid separator 110 may be configured to output the production fluid 112 into the separator annulus 128. The crossflow packer 142 may include a downhole inlet (shown in FIG. 3) in fluid communication with the separator annulus 128. Indeed, the crossflow packer 142 may be configured to receive the production fluid 112 flowing into the separator annulus 128, from the fluid separator 110, via the downhole inlet and direct the formation fluid 108 to flow from the crossflow packer 142 into the upper production tubing 144 such that the production fluid 112 may flow uphole to the surface through the upper production tubing 144.

Further, the fluid separator 110 may be configured to output the formation water 114 to the downhole pump 154 disposed in the lateral bore 104. As set forth above, the fluid separator 110 may be in fluid communication with the downhole pump 154 via the fluid conduit 156 (e.g., tubing) extending between the fluid separator 110 and the downhole pump 154. However, the fluid separator 110 may be in fluid communication with the downhole pump 154 via any suitable flow path. For example, the fluid separator 110 and the downhole pump 154 may alternatively be disposed within a housing such that the formation water may travel directly into the downhole pump 154 from the fluid separator 110 within the housing.

The downhole pump 154 is configured to receive formation water 114 from the fluid separator 110 and pump the formation water 114 to flow into a portion of the lateral bore 104 downhole from the lower lateral packer 118. In particular, the downhole pump 154 is configured to drive the formation water 114 to flow through the lower tubing 158, which extends from the downhole pump 154 to the lower lateral packer 118. Indeed, an upper end of the lower tubing 158 may be in fluid communication with a water outlet (shown in FIG. 2) of the downhole pump 154 such that the formation water 114 may flow into the lower portion 126 of the lateral bore 104 and into the formation 116 around the lower portion 126 of the lateral bore 104. Directing the formation water 114 into the lateral bore 104 and into the formation 116 around the lower portion 126 of the lateral bore 104 may reduce or eliminate the need to pump the formation water 114 back to the surface for separation and may reduce or eliminate the need to transport and/or store the formation water 114.

Moreover, a lower completion assembly 160 may be disposed within the main bore 102 in a position downhole from the completion deflector 140. The lower completion assembly 160 may assist with controlling flow of formation fluid 108 from the main bore 102 to the completion deflector 140 and ultimately to the fluid separator 110. As illustrated, the lower completion assembly 160 may include a lower main production tubing 162 and a plurality of production packers 164 disposed about the lower main production tubing 162. The production packers 164 may be configured to isolate various production zones in the main bore 102. Further, the lower completion assembly 160 may include at least one screen 166 disposed between adjacent packers of the plurality of production packers 164. The at least one screen 166 is configured to filter formation fluid 108 flowing into the lower main production tubing 162. Further, the lower completion assembly 160 may include at least one flow control device 168 configured to control flow of formation fluid 108 into the lower main production tubing 162 from a producing formation 116.

Additionally, as set forth above, the completion deflector 140 may be disposed in the main bore 102 in a position downhole from the junction 106 and uphole from the lower completion assembly 160. The completion deflector 140 may be configured to deflect the fluid separator 110 into the lateral bore 104 during installation of the fluid separator 110. Further, the completion deflector 140 may be fluidly coupled to the lower main production tubing 162 of the lower completion assembly 160. That is, the lower main production tubing 162 may be directly connected to the completion deflector 140 or connected via intermediate tubing such that formation fluid 108 may flow from the lower completion assembly 160 to the completion deflector 140. The completion deflector 140 may be configured to direct formation fluid 108 from the lower completion assembly 160 into the upper annulus 146 of the lateral bore 104 via the central bore 150 of the completion deflector 140 such that the formation fluid 108 may flow to the fluid separator 110 as set forth above.

Figure 2:
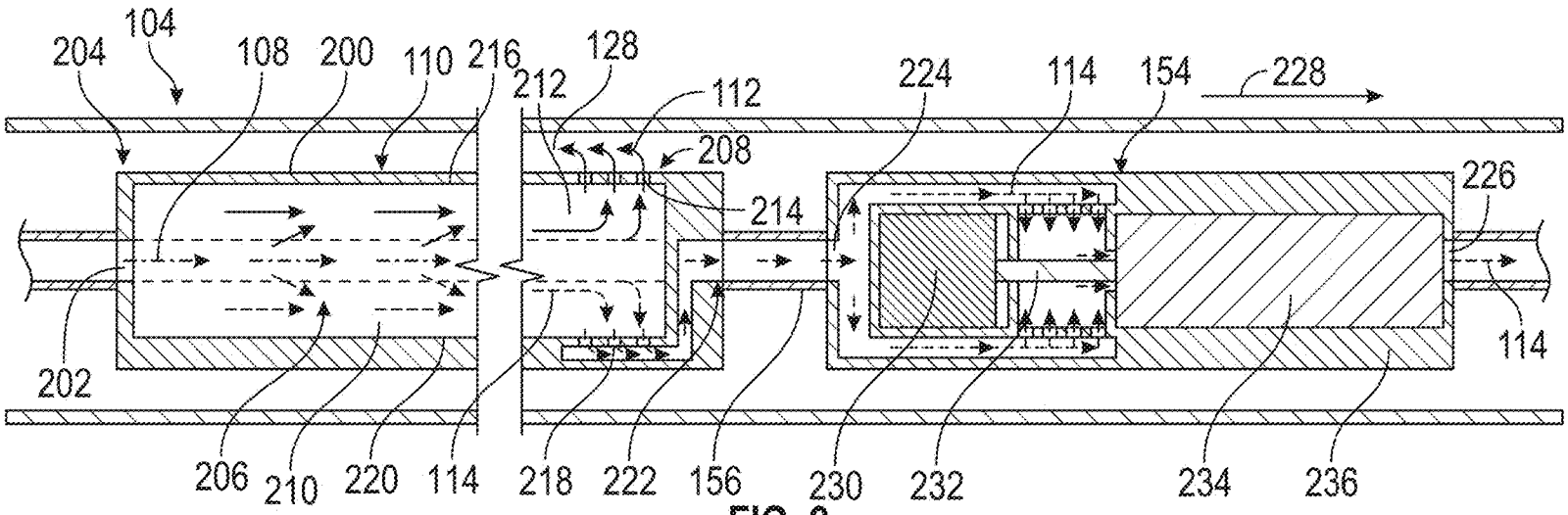
FIG. 2 illustrates a cross-sectional view of a fluid separator and a downhole pump of a downhole assembly disposed in a lateral bore of a multilateral well, in accordance with some embodiments of the present disclosure.

FIG. 2 illustrates a cross-sectional view of a fluid separator and a downhole pump of a downhole assembly disposed in a lateral bore of a multilateral well, in accordance with some embodiments of the present disclosure. The fluid separator 110 may include any suitable separator assembly configured to separate the formation fluid 108 into formation water 114 and production fluid 112. For example, as illustrated, the fluid separator 110 may include a separator housing 200. A fluid inlet 202 may be formed in the separator housing 200. Specifically, the fluid inlet 202 may be formed at an uphole end 204 of the separator housing 200. The fluid separator 110 may be configured to receive the formation fluid 108 from the main bore 102 of the multilateral well 100 (shown in FIG. 1) through the fluid inlet 202.

Additionally, an elongated fluid chamber 206 may be formed in the separator housing 200. As illustrated, formation fluid 108 may flow into the elongated fluid chamber 206 via the fluid inlet 202. In particular, the formation fluid 108 may flow into the uphole end 204 of the elongated fluid chamber 206. The formation fluid may continue to flow through the elongated fluid chamber 206 from the uphole end 204 toward a downhole end 208 of the elongated fluid chamber 206. The elongated fluid chamber 206 may include any suitable length.

As the formation fluid 108 flows through the elongated fluid chamber 206, the formation fluid 108 may gradually separate into the production fluid 112 and the formation water 114 in response to gravitational forces. The formation water 114 may have a higher density than the production fluid 112. Further, oil and water are immiscible. Accordingly, the production fluid 112 and the formation water 114 may separate due to gravitational forces as the formation fluid 108 flows through the elongated fluid chamber 206. As illustrated, the formation water 114 may fall toward a bottom portion 210 of the elongated fluid chamber 206 since the formation water 114 has a higher density than the production fluid 112. For the same reasons, the production fluid 112 may rise toward a top portion 212 of the elongated fluid chamber 206. Ideally, the oil and the water from the formation fluid 108 are completely separated upon reaching the downhole end 208 of the elongated fluid chamber 206. However, in some cases, the oil and the water may not completely separate. As such, the term production fluid 112 may refer to a combination of oil and water having at least 70% oil. Further, the term formation water 114 may refer to a combination of water and oil having at least 70% water.

An oil outlet 214 may be formed in a top portion 212 of the separator housing 200. In particular, the oil outlet 214 may be formed in a top surface 216 of the elongated fluid chamber 206 in a position proximate to the downhole end 208 of the elongated fluid chamber 206. The fluid separator 110 may be positioned and oriented within the lateral bore 104 such that the top portion 212 of the separator housing 200 is oriented with respect to gravity. Further, the separator housing 200 may be disposed within a horizontal portion of the lateral bore 104. Moreover, the oil outlet 214 is in fluid communication with the elongated fluid chamber 206 such that the production fluid 112 may flow into the oil outlet 214 from the elongated fluid chamber 206 after separating from the formation water 114. Further, as illustrated, the oil outlet 214 may be configured to output the production fluid 112 from separator housing 200 and into the annulus (e.g., the separator annulus 128) disposed about the fluid separator 110.

Moreover, a water outlet 218 may be formed in a bottom portion 210 of the separator housing 200. In particular, the water outlet 218 may be formed in a bottom surface 220 of the elongated fluid chamber 206 in a position proximate to the downhole end 208 of the elongated fluid chamber 206. The water outlet 218 is in fluid communication with the elongated fluid chamber 206 such that the formation water 114 may flow into the water outlet 218 from the elongated fluid chamber 206 after separating from the production fluid 112. Further, as illustrated, the water outlet 218 may be configured to output the formation water 114 from a downhole end 222 of the separator housing 200 such that the formation water 114 may flow into the downhole pump 154. Indeed, the fluid conduit 156 may extend between the water outlet 218 of the fluid separator 110 and a pump inlet 224 of the downhole pump 154 such that the formation water 114 output from the fluid separator 110 may flow directly into the downhole pump 154.

As illustrated, the downhole pump 154 may include an electrical submersible pump. The electrical submersible pump may include a motor 230, a drive shaft 232, and pump portion 234, each disposed within a pump housing 236. The motor may be configured to actuate the drive shaft 232. Further, the drive shaft 232 may be configured drive the pump portion 234 such that the pump portion 234 may pull the formation water 114 from an upper end 238 of the pump portion 234 and pump the formation water 114 out of a pump outlet 226 in the downhole direction 228 toward the lower portion 126 of the lateral bore 104 (shown in FIG. 1). However, the downhole pump 154 may include any suitable pump configured to receive the formation water 114 from the fluid separator 110 and pump the formation water 114 toward the lower portion of the lateral bore 104.

Figure 3:
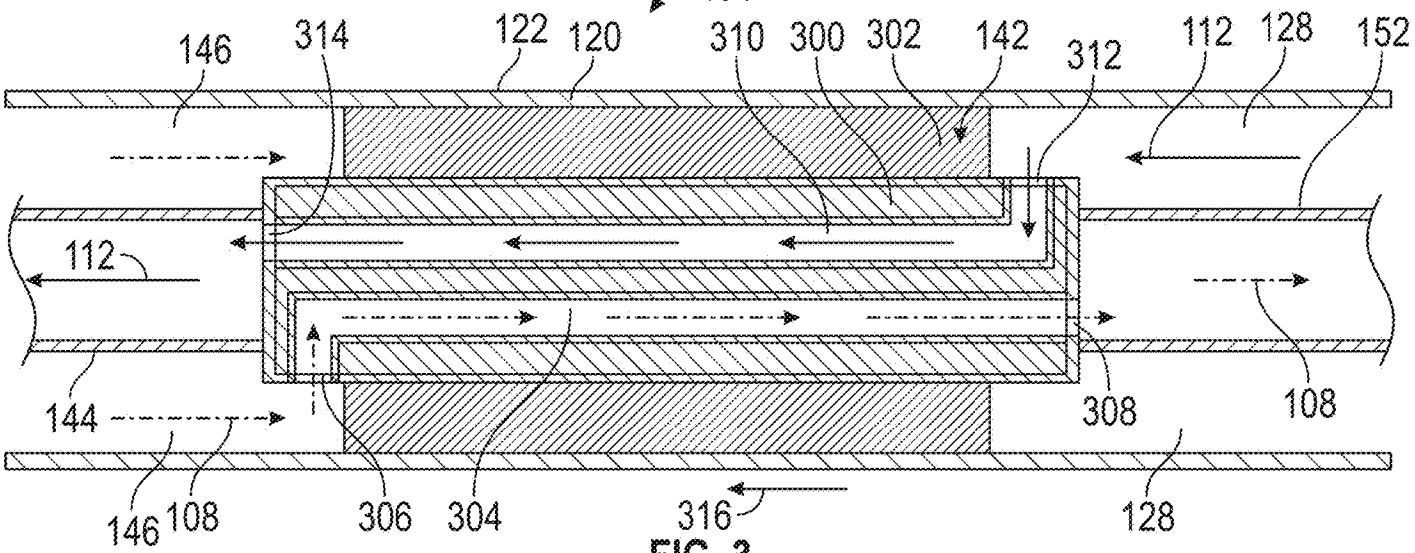
FIG. 3 illustrates a cross-sectional view of a crossflow packer configured to output formation fluid to a fluid separator and receive production fluid from the fluid separator, in accordance with some embodiments of the present disclosure.

FIG. 3 illustrates a cross-sectional view of a crossflow packer configured to output formation fluid to a fluid separator and receive formation oil from the fluid separator, in accordance with some embodiments of the present disclosure. The crossflow packer 142 may include an suitable packer assembly configured seal an annulus of a wellbore, as well as direct an uphole annulus flow into a downhole tubular and direct a downhole annulus flow into an uphole tubular. For example, as illustrated, the crossflow packer 142 may include a crossflow housing 300 and an expandable portion 302. The expandable portion 302 may be configured to expand once the crossflow packer 142 is positioned in a desired location in the lateral bore 104 such that the expandable portion 302 may seal the crossflow housing 300 against the lateral bore casing 120 or the wellbore wall 122 of the lateral bore 104. Indeed, the crossflow packer 142 may be configured to isolate the annulus above the crossflow packer (e.g., the upper annulus 146) from the annulus disposed below the crossflow packer (e.g., the separator annulus 128).

Moreover, a first crossflow path 304 may be formed within the crossflow housing 300. The first crossflow path 304 may extend from an uphole crossflow inlet 306 to a downhole crossflow outlet 308. As illustrated, the uphole crossflow inlet 306 may be in fluid communication with the upper annulus 146 such that the formation fluid 108 flowing uphole from the main bore 102 (shown in FIG. 1) may flow into the first crossflow path 304 via the uphole crossflow inlet 306. The formation fluid 108 flowing through the first crossflow path 304 may exit the crossflow housing 300 via the downhole crossflow outlet 308. As illustrated, the downhole crossflow outlet 308 may be in fluid communication with the connection tubing 152 secured to the downhole crossflow outlet 308. Further, the connection tubing 152 may extend from the downhole crossflow outlet 308 to the fluid separator 110 (shown in FIG. 1) such that the crossflow packer 142 may direct the formation fluid 108 from the upper annulus 146 to flow into the fluid separator 110.

Additionally, a second crossflow path 310 may be formed within the crossflow housing 300. As illustrated, the second crossflow path 310 may extend from a downhole crossflow inlet 312 to an uphole crossflow outlet 314. As illustrated, the downhole crossflow inlet 312 may be in fluid communication with the separator annulus 128 such that the production fluid 112 output from the fluid separator 110 may flow into the second crossflow path 310 via the downhole crossflow inlet 312. The formation fluid 108 flowing through the second crossflow path 310 may exit the crossflow housing 300 via the uphole crossflow outlet 314. As illustrated, the uphole crossflow outlet 314 may be in fluid communication with the upper production tubing 144 secured to the uphole crossflow outlet 314. Further, the upper production tubing 144 may extend from the uphole crossflow outlet 314 in the uphole direction 316 toward the surface such that the crossflow packer 142 may direct the formation fluid 108 from the separator annulus 128 to flow toward the surface via the upper production tubing 144.

Figure 4:
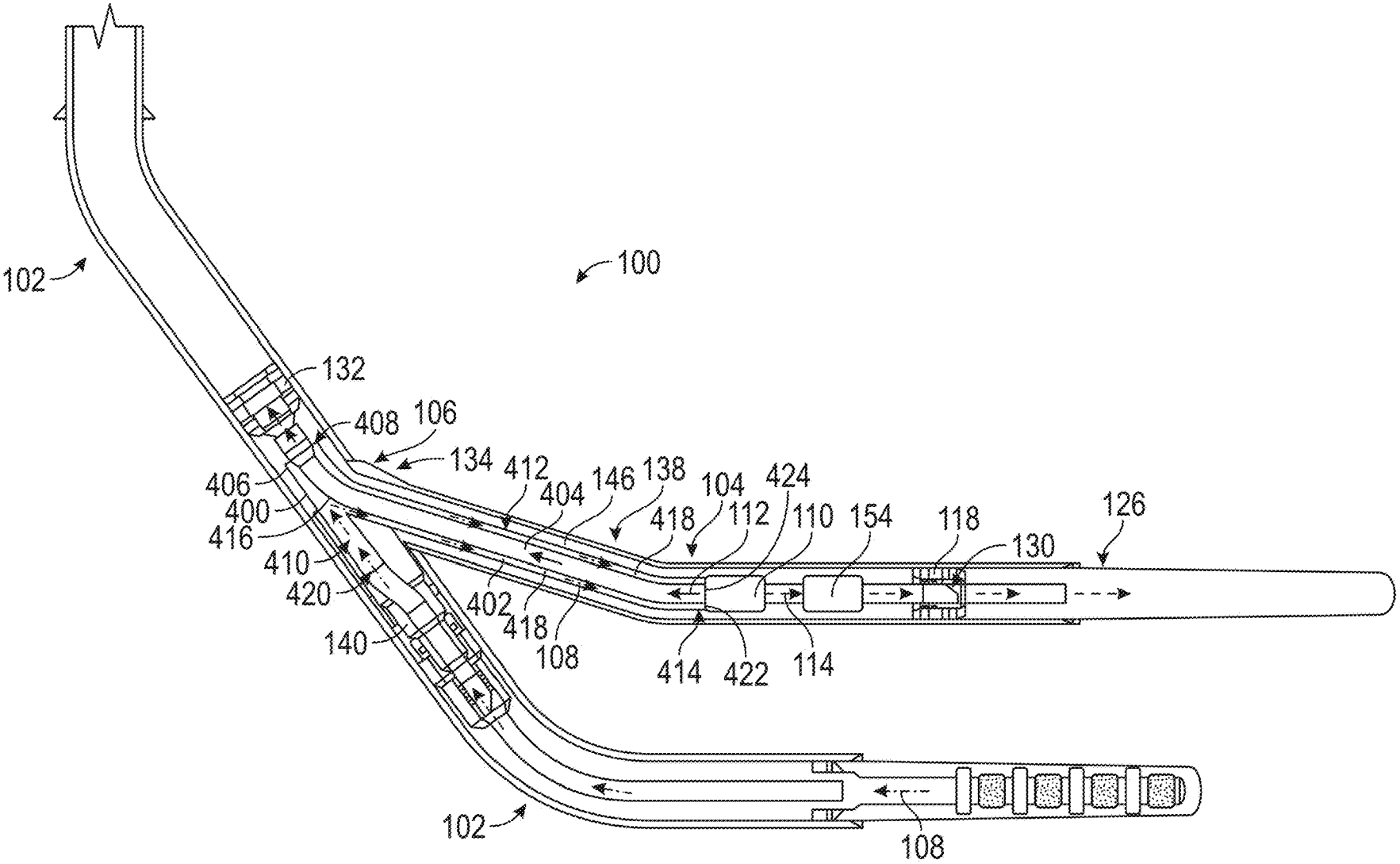
FIG. 4 illustrates a downhole assembly with a completion deflector and a fluid separator jointly run into a multilateral well to position the fluid separator in a lateral bore of the multilateral well and the completion deflector in a main bore of the multilateral well, in accordance with some embodiments of the present disclosure.

FIG. 4 illustrates a downhole assembly with a completion deflector and a fluid separator jointly run into a multilateral well to position the fluid separator in a lateral bore of the multilateral well and the completion deflector in a main bore of the multilateral well, in accordance with some embodiments of the present disclosure. As illustrated, the multilateral well 100 may include a Technology Advancement of Multilaterals (TAML) level 5 on a new or existing well with re-entry. However, the multilateral well 100 may include any suitable type of multilateral well 100 and completion having the lateral bore 104 deviate from the main bore 102 at a junction 106. Moreover, as set forth above, the main bore 102 may produce the formation fluid 108.

As set forth above, the fluid separator 110 may be disposed within the lateral bore 104 of the multilateral well 100 to receive the formation fluid 108 flowing from the main bore 102 and to separate the formation fluid 108 (e.g., oil and water) into the production fluid 112 and the formation water 114. Generally, the fluid separator 110 is configured to output the production fluid 112 to flow uphole toward the surface of production operations and output the formation water 114 to flow into a portion of the lateral bore 104 disposed downhole from the fluid separator 110 such that the formation water 114 may flow into the lateral bore 104 and the formation 116 around the lateral bore 104.

Further, as set forth above, the lower lateral packer 118 may be disposed within the lateral bore 104 in a position downhole from the fluid separator 110. The lower lateral packer 118 may be configured to isolate the upper portion 138 of the lateral bore 104 from a lower portion 126 of the lateral bore 104. In particular, the lower lateral packer 118 may be configured to isolate the upper annulus 146 from the lower portion 126 of the lateral bore 104. As illustrated, the upper annulus 146 may extend from the lower lateral packer 118 to the upper main bore packer 132. As such, the lower lateral packer 118 may be configured to isolate the lower portion 126 of the lateral bore 104 from the upper portion 138 of the lateral bore 104 and the junction portion 134 of the multilateral well 100. Moreover, as illustrated, the fluid separator 110 may be disposed within the upper portion 138 of the lateral bore 104. Further, the formation water 114 output from the fluid separator 110 may be directed to flow to the downhole pump 154, and the downhole pump 154 may be configured to pump the formation water 114 downhole through the central bore 130 of the lower lateral packer 118 and into the lower portion 126 of the lateral bore 104.

Moreover, a junction tubing 400 may be disposed in the junction portion 134 and/or the upper portion 138 of the lateral bore 104. As illustrated, the junction tubing 400 is configured to provide a first flow path 402 for the formation fluid 108 to flow from the main bore 102 to the fluid separator 110 and a second flow path 404 for the production fluid 112 to flow from the fluid separator 110 toward the surface. Specifically, the junction tubing 400 may include a main tubing portion 406 having an upper end 408 positioned proximate the upper main bore packer 132. The junction tubing 400 may further include a first tubing branch 410 extending from the main tubing portion 406 through the junction 106 and into the main bore 102. In particular, the first tubing branch 410 may extend into the completion deflector 140 to fluidly couple the first tubing branch 410 with the main bore 102 such that the formation fluid 108 may flow into the first tubing branch 410 from the main bore 102. The junction tubing 400 may also include a second tubing branch 412 extending from the main tubing portion 406 into the lateral bore 104 and to the fluid separator 110. As illustrated, a lower end 414 of the second tubing branch 412 may be secured to the fluid separator 110.

Further, the junction tubing 400 may include an inner tubing 416 extending from the lower end 414 of the second tubing branch 412 to at least the upper end 408 of the main tubing portion 406. A junction annulus 418 is formed between the outer surface of the inner tubing 416 and the inner surface of the second tubing branch 412. Additionally, an upper portion of the junction annulus 418 may be formed between the outer surface of the inner tubing 416 and the inner surface of the main tubing portion 406.

As set forth above, junction tubing 400 may provide the first flow path 402 for the formation fluid 108 to flow from the main bore 102 to the fluid separator 110. Specifically, the first flow path 402 may extend from a lower end 420 of the first tubing branch 410 and through the junction annulus 418 to the fluid separator 110. As set forth above, the fluid separator 110 may include an upper separator inlet 422 configured to receive the formation fluid 108 via the junction annulus 418. Further, as set forth above, the junction tubing 400 may provide the second flow path 404 for the production fluid 112 to flow from the fluid separator 110 toward the surface. The second flow path 404 extends through the inner tubing 416. Indeed, after the formation fluid 108 flows into the fluid separator 110 and is separated into the formation water 114 and the production fluid 112, the fluid separator 110 may output the production fluid 112 via an upper separator outlet 424. The upper separator outlet 424 may be fluidly coupled to the inner tubing 416 such that the production fluid 112 may be output into the inner tubing 416 and flow uphole toward the surface. Moreover, as set forth above, the formation water 114 may be output to the downhole pump 154 and directed to the lower portion 126 of the lateral bore 104.

Figure 5:
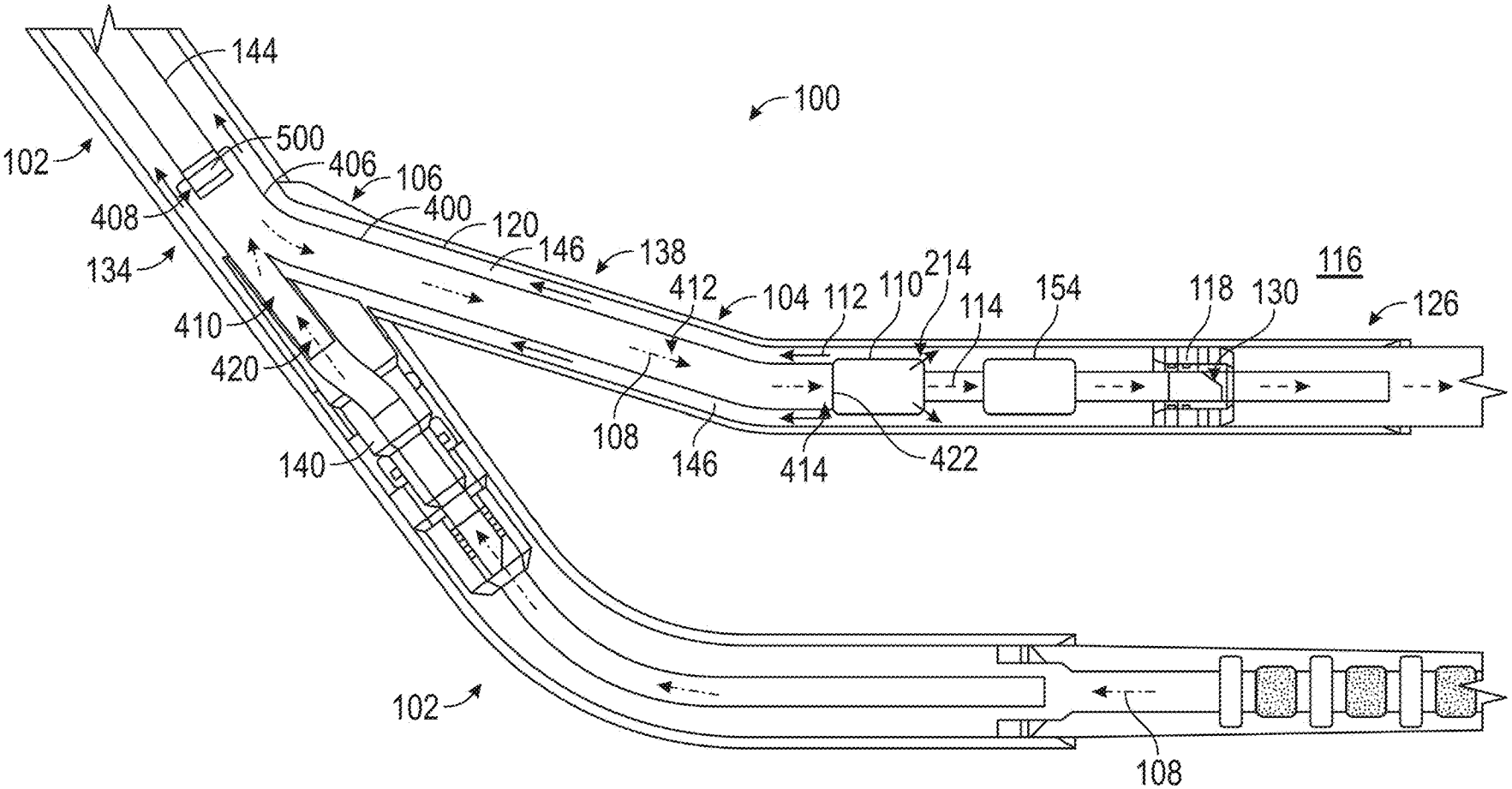
FIG. 5 illustrates a downhole assembly with a plug positioned to direct flow of formation fluid from a main bore of a multilateral well toward a fluid separator disposed in a lateral bore of the multilateral well, in accordance with some embodiments of the present disclosure.

FIG. 5 illustrates a downhole assembly with a plug positioned to direct flow of formation fluid from a main bore of a multilateral well toward a fluid separator disposed in a lateral bore of the multilateral well, in accordance with some embodiments of the present disclosure. As illustrated, the multilateral well 100 may include a Technology Advancement of Multilaterals (TAML) level 5 on a new or existing well with re-entry. However, the multilateral well 100 may include any suitable type of multilateral well 100 and completion having the lateral bore 104 deviate from the main bore 102 at a junction 106. Moreover, as set forth above, the main bore 102 may produce the formation fluid 108.

As set forth above, the fluid separator 110 may be disposed within the lateral bore 104 of the multilateral well 100 to receive the formation fluid 108 flowing from the main bore 102 and to separate the formation fluid 108 (e.g., oil and water) into the production fluid 112 and the formation water 114. Generally, the fluid separator 110 is configured to output the production fluid 112 to flow uphole toward the surface of production operations and output the formation water 114 to flow into a portion (e.g., the lower portion 126) of the lateral bore 104 disposed downhole from the fluid separator 110 such that the formation water 114 may flow into the lateral bore 104 and the formation 116 around the lateral bore 104.

Further, as set forth above, the lower lateral packer 118 may be disposed within the lateral bore 104 in a position downhole from the fluid separator 110. The lower lateral packer 118 may be configured to isolate the upper portion 138 of the lateral bore 104 from the lower portion 126 of the lateral bore 104. In particular, the lower lateral packer 118 may be configured to isolate the upper annulus 146 from the lower portion 126 of the lateral bore 104. As such, the lower lateral packer 118 may be configured to isolate the lower portion 126 of the lateral bore 104 from the upper portion 138 of the lateral bore 104 and the junction portion 134 of the multilateral well 100. Moreover, as illustrated, the fluid separator 110 may be disposed within the upper portion 138 of the lateral bore 104. Further, the formation water 114 output from the fluid separator 110 may be directed to flow to the downhole pump 154, and the downhole pump 154 may be configured to pump the formation water 114 downhole through the central bore 130 of the lower lateral packer 118 and into the lower portion 126 of the lateral bore 104.

Moreover, as set forth above, the junction tubing 400 may be disposed in the junction portion 134 and/or the upper portion 138 of the lateral bore 104. The junction tubing 400 is configured to provide a flow path for the formation fluid 108 to flow from the main bore 102 to the fluid separator 110. Specifically, the junction tubing 400 may include the main tubing portion 406 having the upper end 408 positioned in the junction 106 or uphole from the junction 106. As illustrated, the upper end 408 of the main tubing portion 406 may be secured to the upper production tubing 144 extending uphole toward the surface. However, a downhole plug 500 may be disposed in the main tubing portion 406 and/or the upper production tubing 144 to form a seal that prevents the formation fluid 108 flowing through the junction tubing 400 from passing into the upper production tubing 144. That is, the downhole plug 500 may be configured to isolate the junction tubing 400 from the upper production tubing 144 such that the formation fluid 108 cannot flow directly into the upper production tubing 144 and toward the surface from the junction tubing 400.

Moreover, the junction tubing 400 may further include the first tubing branch 410 extending from the main tubing portion 406 through the junction 106 and into the main bore 102. In particular, the first tubing branch 410 may extend into the completion deflector 140 to fluidly couple the first tubing branch 410 with the main bore 102 such that the formation fluid 108 may flow into the first tubing branch 410 from the main bore 102. The junction tubing 400 may also include the second tubing branch 412 extending from the main tubing portion 406 into the lateral bore 104 and to the fluid separator 110. As illustrated, the lower end 414 of the second tubing branch 412 may be secured to the fluid separator 110.

As set forth above, the junction tubing 400 may provide a flow path for the formation fluid 108 to flow from the main bore 102 to the fluid separator 110. Specifically, the flow path may extend from the lower end 420 of the first tubing branch 410 toward the main tubing portion 406 and through the second tubing branch 412 to the fluid separator 110. The fluid separator 110 may include the upper separator inlet 422 configured to receive the formation fluid 108 via the second tubing branch 412. After the formation fluid 108 flows into the fluid separator 110 and is separated into the formation water 114 and the production fluid 112, the fluid separator 110 may output the production fluid 112 via the oil outlet 214. The oil outlet 214 may be fluidly coupled to the upper annulus 146 such that the fluid separator 110 is configured to output the production fluid 112 to into an upper annulus 146. The upper annulus 146 may be formed between the junction tubing 400 and a lateral bore casing 120. Further, as illustrated, the upper annulus 146 may extend uphole through the main bore 102 toward the surface. That is, the upper annulus 146 may extend past the downhole plug 500 and along the upper production tubing 144 such that the production fluid 112 flowing into the upper annulus 146 from the fluid separator 110 may flow toward the surface. Moreover, as set forth above, the formation water 114 may be output from the fluid separator 110 to the downhole pump 154 and directed to the lower portion 126 of the lateral bore 104.

Accordingly, the present disclosure may provide a downhole fluid separator disposed in a lateral bore of a multilateral well to output formation water into the formation about the lateral bore and output formation oil toward the surface. The systems and method set forth in this application may include any of the various features disclosed herein, including one or more of the following statements.

Statement 1. A system comprising: a fluid separator disposed within a lateral bore of a multilateral well, wherein the fluid separator is configured to receive formation fluid from a main bore of the multilateral well and separate the formation fluid into formation water and production fluid, wherein the fluid separator is configured to output the production fluid to flow uphole; a lower lateral packer disposed within the lateral bore in a position downhole from the fluid separator; and a downhole pump disposed in the lateral bore, wherein the downhole pump is configured to receive formation water from the fluid separator and pump the formation water to flow into a portion of the lateral bore downhole from the lower lateral packer.

Statement 2. The system of statement 1, further comprising a lower tubing extending between the downhole pump and the lower lateral packer, wherein an upper end of the lower tubing is in fluid communication with a water outlet of the downhole pump, and wherein the formation water is configured to flow into the portion of the lateral bore downhole from the lower lateral packer via the lower tubing.

Statement 3. The system of statement 1 or statement 2, further comprising a fluid conduit extending between a water outlet of the fluid separator and a water inlet of the downhole pump.

Statement 4. The system of any preceding statement, further comprising a crossflow packer secured within the lateral bore, wherein an uphole end of the crossflow packer is configured to receive the formation fluid from an annulus of the lateral bore, via an uphole inlet, and direct the formation fluid to flow downhole to the fluid separator via a connection tubing secured to a downhole outlet of the crossflow packer, and wherein a downhole inlet of the crossflow packer is configured to receive the production fluid flowing from the separator, via a downhole inlet, and direct the formation fluid to flow uphole to an upper production tubing secured to an uphole outlet of the crossflow packer.

Statement 5. The system of any preceding statement, wherein the upper production tubing extends from the crossflow packer, into the main bore, and toward a surface of the multilateral well.

Statement 6. The system of any preceding statement, further comprising an upper main bore packer disposed in the main bore in a position uphole from a junction of the multilateral well, wherein the upper production tubing is configured to seal an annulus of the main bore about the upper production tubing, and wherein formation fluid flowing into the annulus of the main bore from a production zone is directed to flow toward the crossflow packer disposed in the lateral bore.

Statement 7. The system of any preceding statement, wherein the fluid separator comprises: a separator housing; a fluid inlet formed in the separator housing, wherein the fluid inlet is disposed at an uphole end of the separator housing, wherein the fluid inlet is configured to receive the formation fluid from the main bore of the multilateral well; an elongated fluid chamber formed in the separator housing, wherein the formation fluid is configured to flow into the elongated fluid chamber via the fluid inlet, and wherein the formation fluid is configured to separate in response to gravity as the formation fluid flows through the elongated fluid chamber; a water outlet formed in a bottom portion of the separator housing in a position downhole from the fluid inlet, wherein the formation water is configured to flow through the water outlet from the elongated fluid chamber; and an oil outlet formed in a top portion of the separator housing in a position downhole from the fluid inlet, wherein the production fluid is configured to flow through the oil outlet from the elongated fluid chamber.

Statement 8. The system of any of statements 1-3 and 7, further comprising a junction tubing configured to provide a flow path for the formation fluid to flow from the main bore to the fluid separator, wherein the junction tubing includes a main tubing portion, a first tubing branch extending into the main bore, and a second tubing branch extending into the lateral bore to the fluid separator, wherein the formation fluid is configured to flow from into the first tubing branch, through the first tubing branch, through the main tubing portion, through the second tubing branch, and into the fluid separator.

Statement 9. The system of any of statements 1-3, 7, and 8, further comprising a downhole plug, wherein an uphole end of the main tubing portion is secured to a production tubing extending uphole toward a surface of the multilateral well, and wherein the downhole plug is disposed in the main tubing portion and/or an upper production tubing to form a seal and prevent the formation fluid from flowing into the upper production tubing and toward the surface via the junction tubing.

Statement 10. The system of any of statements 1-3 and 7-9, wherein the wherein the fluid separator is configured to output the production fluid to into an upper annulus of the lateral bore, wherein the upper annulus is formed between the junction tubing and a lateral bore casing, and wherein the production fluid is configured to flow through the upper annulus toward a surface of the multilateral well.

Statement 11. The system of any of statements 1-3 and 7, further comprising a junction tubing configured to provide a first flow path for the formation fluid to flow from the main bore to the fluid separator and a second flow path for the production fluid to flow from the fluid separator toward a surface of the multilateral well, wherein the junction tubing includes a main tubing portion, a first tubing branch extending into the main bore, and a second tubing branch extending into the lateral bore to the fluid separator, wherein the junction tubing further includes an inner tubing extending from an upper end of the main tubing portion to a lower end of the second tubing branch, wherein the first flow path extends from a lower end of the first tubing branch and through a junction annulus formed between an inner surface of the second tubing branch and an outer surface of the inner tubing to the fluid separator, and wherein the second flow path extends through the inner tubing.

Statement 12. The system of any preceding statement, wherein the downhole pump includes an electrical submersible pump.

Statement 13. The system of any preceding statement, further comprising a lower completion assembly disposed within the main bore in a position downhole from a completion deflector, wherein the lower completion assembly includes: a lower main production tubing; a plurality of completion packers disposed about the lower main production tubing and configured to isolate production zones in the main bore; at least one screen disposed within between adjacent packers of the plurality of completion packers, wherein the at least one screen is configured to filter production fluid flowing into the lower main production tubing; and a flow control device configured to control flow of formation fluid into the lower main production tubing.

Statement 14. The system of any of statements 1-7, 12, and 13, a completion deflector disposed in the main bore in a position downhole from a junction between the lateral bore and the main bore, wherein the completion deflector is configured to deflect the fluid separator into the lateral bore during installation of the fluid separator, wherein the completion deflector is fluidly coupled to the lower completion assembly via a lower main production tubing, wherein the completion deflector is configured to direct formation fluid from the lower completion assembly into an annulus of the lateral bore via a central bore of the completion deflector.

Statement 15. The system of any of statements 1-3 and 7-13, a completion deflector disposed in the main bore in a position downhole from a junction between the lateral bore and the main bore, wherein the completion deflector is configured to deflect the fluid separator into the lateral bore during installation of the fluid separator, wherein the completion deflector is fluidly coupled to the lower completion assembly via a lower main production tubing, wherein the completion deflector is configured to direct formation fluid from the lower completion assembly into a junction tubing having main tubing portion, a first tubing branch extending into the completion deflector, and a second tubing branch extending into the lateral bore to the fluid separator.

Statement 16. A system comprising: a fluid separator disposed within a lateral bore of a multilateral well, wherein the fluid separator is configured to receive formation fluid from a main bore of the multilateral well and separate the formation fluid into formation water and production fluid, wherein the fluid separator is configured to output the production fluid into a lower annulus; a lower lateral packer disposed within the lateral bore in a position downhole from the fluid separator; an upper main bore packer disposed in the main bore in a position uphole from a junction between the main bore and the lateral bore; a crossflow packer disposed within the lateral bore in a position uphole from the fluid separator, wherein an upper production tubing extends from the crossflow packer and through the upper main bore packer toward a surface of the multilateral well, wherein the crossflow packer and the upper main bore packer are configured to seal an upper annulus formed uphole from the fluid separator to direct flow of formation fluid from the main bore through the upper annulus, into the crossflow packer, and toward the fluid separator via a connection tubing extending between the crossflow packer and the fluid separator, and wherein the crossflow packer and the lower lateral packer are configured to seal the lower annulus about the fluid separator to direct flow of the production fluid output from the fluid separator into the crossflow packer and to the upper production tubing; and a downhole pump disposed in the lateral bore, wherein the downhole pump is configured to receive formation water from the fluid separator via a fluid conduit extending between a water outlet of the fluid separator and a water inlet of the downhole pump, wherein the downhole pump is configured to pump the formation water into a portion of the lateral bore downhole from the lower lateral packer via a lower tubing extending from the downhole pump and into the lower lateral packer.

Statement 17. A method of separating oil from water downhole in a multilateral well comprising: directing formation fluid from a main bore of a multilateral well to flow into a lateral bore of the multilateral well; drawing a formation fluid into a fluid separator from the lateral bore, wherein the fluid separator is located in the lateral bore, and wherein the formation fluid at least includes formation water and formation water; separating production fluid from formation water via the fluid separator; outputting the production fluid from the fluid separator to flow uphole toward a surface; and injecting the formation water from the fluid separator into a downhole formation disposed about the lateral bore.

Statement 18. The method of statement 17, wherein the production fluid output from the fluid separator is configured to flow into a crossflow packer, flow through production tubing extending between the crossflow packer and an upper main bore packer and continue to flow uphole toward the surface.

Statement 19. The method of statement 17 or statements 18, wherein the production fluid is configured to flow uphole from the fluid separator toward the surface through an inner tubing disposed within a junction tubing, and wherein the formation water is output from the fluid separator to flow through a lower lateral packer to inject the formation water a lower portion of the lateral bore.

Statement 20. The method of any of statements 17-19, wherein the production fluid is configured to flow uphole from the fluid separator toward the surface through lateral annulus formed in the lateral bore and a main annulus formed in the main bore.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. The systems and methods may comprise any of the various features disclosed herein, comprising one or more of the following statements.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A system comprising:

a fluid separator disposed within a lateral bore of a multilateral well, wherein the fluid separator is configured to receive formation fluid that is produced via a lower completion assembly disposed in a main bore of the multilateral well and separate the formation fluid into formation water and production fluid, wherein the fluid separator is configured to output the production fluid to flow uphole;

a lower lateral packer disposed within the lateral bore in a position downhole from the fluid separator;

a downhole pump disposed in the lateral bore, wherein the downhole pump is configured to receive the formation water from the fluid separator and pump the formation water to flow into a portion of the lateral bore downhole from the lower lateral packer; and a crossflow packer secured within the lateral bore, wherein an uphole end of the crossflow packer is configured to receive the formation fluid from an annulus of the lateral bore, via an uphole inlet, and direct the formation fluid to flow downhole to the fluid separator via a connection tubing secured to a downhole outlet of the crossflow packer, and wherein a downhole end of the crossflow packer is configured to receive the production fluid flowing from the fluid separator, via a downhole inlet, and direct the production fluid to flow uphole to an upper production tubing secured to an uphole outlet of the crossflow packer.

2. The system of claim 1, further comprising a lower tubing extending between the downhole pump and the lower lateral packer, wherein an upper end of the lower tubing is in fluid communication with a water outlet of the downhole pump, and wherein the formation water is directed to flow into the portion of the lateral bore downhole from the lower lateral packer via the lower tubing.

3. The system of claim 1, further comprising a fluid conduit extending between a water outlet of the fluid separator and a water inlet of the downhole pump.

4. The system of claim 1, wherein the upper production tubing extends from the crossflow packer, into the main bore, and toward a surface of the multilateral well.

5. The system of claim 1, further comprising an upper main bore packer disposed in the main bore in a position uphole from a junction of the multilateral well, wherein the upper main bore packer is configured to seal an annulus of the main bore about the upper production tubing, and wherein formation fluid flowing into the annulus of the main bore from a production zone is directed to flow toward the crossflow packer disposed in the lateral bore.

6. The system of claim 1, wherein the downhole pump includes an electrical submersible pump.

7. The system of claim 1, wherein the lower completion assembly is disposed within the main bore in a position downhole from a completion deflector, wherein the lower completion assembly includes:

a lower main production tubing;

a plurality of completion packers disposed about the lower main production tubing and configured to isolate production zones in the main bore;

at least one screen disposed within between adjacent packers of the plurality of completion packers, wherein the at least one screen is configured to filter production fluid flowing into the lower main production tubing; and a flow control device configured to control flow of formation fluid into the lower main production tubing.

8. A system comprising:

a fluid separator disposed within a lateral bore of a multilateral well, wherein the fluid separator is configured to receive formation fluid that is produced via a lower completion assembly disposed in a main bore of the multilateral well and separate the formation fluid into formation water and production fluid, wherein the fluid separator is configured to output the production fluid to flow uphole wherein the fluid separator comprises:

a separator housing;

a fluid inlet formed in the separator housing, wherein the fluid inlet is disposed at an uphole end of the separator housing, wherein the fluid inlet is configured to receive the formation fluid from the main bore of the multilateral well;

an elongated fluid chamber formed in the separator housing, wherein the formation fluid is directed to flow into the elongated fluid chamber via the fluid inlet, and wherein the formation fluid is separated in response to gravity as the formation fluid flows through the elongated fluid chamber;

a water outlet formed in a bottom portion of the separator housing in a position downhole from the fluid inlet, wherein the formation water is directed to flow through the water outlet from the elongated fluid chamber; and an oil outlet formed in a top portion of the separator housing in a position downhole from the fluid inlet, wherein the production fluid is directed to flow through the oil outlet from the elongated fluid chamber;

a lower lateral packer disposed within the lateral bore in a position downhole from the fluid separator; and a downhole pump disposed in the lateral bore, wherein the downhole pump is configured to receive the formation water from the fluid separator and pump the formation water to flow into a portion of the lateral bore downhole from the lower lateral packer.

9. A system comprising:

a fluid separator disposed within a lateral bore of a multilateral well, wherein the fluid separator is configured to receive formation fluid that is produced via a lower completion assembly disposed in a main bore of the multilateral well and separate the formation fluid into formation water and production fluid, wherein the fluid separator is configured to output the production fluid to flow uphole;

a lower lateral packer disposed within the lateral bore in a position downhole from the fluid separator;

a downhole pump disposed in the lateral bore, wherein the downhole pump is configured to receive the formation water from the fluid separator and pump the formation water to flow into a portion of the lateral bore downhole from the lower lateral packer; and a junction tubing configured to provide a flow path for the formation fluid to flow from the main bore to the fluid separator, wherein the junction tubing includes a main tubing portion, a first tubing branch extending into the main bore, and a second tubing branch extending into the lateral bore to the fluid separator, wherein the formation fluid is directed to flow through the first tubing branch, through the main tubing portion, through the second tubing branch, and into the fluid separator.

10. The system of claim 9, further comprising a downhole plug, wherein an uphole end of the main tubing portion is secured to a production tubing extending uphole toward a surface of the multilateral well, and wherein the downhole plug is disposed in the main tubing portion and/or an upper production tubing to form a seal and prevent the formation fluid from flowing into the upper production tubing and toward the surface via the junction tubing.

11. The system of claim 9, wherein the fluid separator is configured to output the production fluid to into an upper annulus of the lateral bore, wherein the upper annulus is formed between the junction tubing and a lateral bore casing, and wherein the production fluid is directed to flow through the upper annulus toward a surface of the multilateral well.

12. A system comprising:

a fluid separator disposed within a lateral bore of a multilateral well, wherein the fluid separator is configured to receive formation fluid that is produced via a lower completion assembly disposed in a main bore of the multilateral well and separate the formation fluid into formation water and production fluid, wherein the fluid separator is configured to output the production fluid to flow uphole;

a lower lateral packer disposed within the lateral bore in a position downhole from the fluid separator;

a downhole pump disposed in the lateral bore, wherein the downhole pump is configured to receive the formation water from the fluid separator and pump the formation water to flow into a portion of the lateral bore downhole from the lower lateral packer; and a junction tubing configured to provide a first flow path for the formation fluid to flow from the main bore to the fluid separator and a second flow path for the production fluid to flow from the fluid separator toward a surface of the multilateral well, wherein the junction tubing includes a main tubing portion, a first tubing branch extending into the main bore, and a second tubing branch extending into the lateral bore to the fluid separator, wherein the junction tubing further includes an inner tubing extending from an upper end of the main tubing portion to a lower end of the second tubing branch, wherein the first flow path extends from a lower end of the first tubing branch and through a junction annulus formed between an inner surface of the second tubing branch and an outer surface of the inner tubing to the fluid separator, and wherein the second flow path extends through the inner tubing.

13. A system comprising a fluid separator disposed within a lateral bore of a multilateral well, wherein the fluid separator is configured to receive formation fluid that is produced via a lower completion assembly disposed in a main bore of the multilateral well and separate the formation fluid into formation water and production fluid, wherein the fluid separator is configured to output the production fluid to flow uphole, and wherein the lower completion assembly is disposed within the main bore in a position downhole from a completion deflector, wherein the lower completion assembly includes:

a lower main production tubing;

a plurality of completion packers disposed about the lower main production tubing and configured to isolate production zones in the main bore;

at least one screen disposed within between adjacent packers of the plurality of completion packers, wherein the at least one screen is configured to filter production fluid flowing into the lower main production tubing; and a flow control device configured to control flow of formation fluid into the lower main production tubing;

a lower lateral packer disposed within the lateral bore in a position downhole from the fluid separator; and a downhole pump disposed in the lateral bore, wherein the downhole pump is configured to receive the formation water from the fluid separator and pump the formation water to flow into a portion of the lateral bore downhole from the lower lateral packer, wherein the completion deflector is disposed in the main bore in a position downhole from a junction between the lateral bore and the main bore, wherein the completion deflector is configured to deflect the fluid separator into the lateral bore during installation of the fluid separator, wherein the completion deflector is fluidly coupled to the lower completion assembly via a lower main production tubing, wherein the completion deflector is configured to direct formation fluid from the lower completion assembly into an annulus of the lateral bore via a central bore of the completion deflector.

14. A system comprising:

a fluid separator disposed within a lateral bore of a multilateral well, wherein the fluid separator is configured to receive formation fluid that is produced via a lower completion assembly disposed in a main bore of the multilateral well and separate the formation fluid into formation water and production fluid, wherein the fluid separator is configured to output the production fluid to flow uphole, and wherein the lower completion assembly is disposed within the main bore in a position downhole from a completion deflector, wherein the lower completion assembly includes:

a lower main production tubing;

a plurality of completion packers disposed about the lower main production tubing and configured to isolate production zones in the main bore;

at least one screen disposed within between adjacent packers of the plurality of completion packers, wherein the at least one screen is configured to filter production fluid flowing into the lower main production tubing; and a flow control device configured to control flow of formation fluid into the lower main production tubing;

a lower lateral packer disposed within the lateral bore in a position downhole from the fluid separator; and a downhole pump disposed in the lateral bore, wherein the downhole pump is configured to receive the formation water from the fluid separator and pump the formation water to flow into a portion of the lateral bore downhole from the lower lateral packer, wherein the completion deflector is disposed in the main bore in a position downhole from a junction between the lateral bore and the main bore, wherein the completion deflector is configured to deflect the fluid separator into the lateral bore during installation of the fluid separator, wherein the completion deflector is fluidly coupled to the lower completion assembly via a lower main production tubing, wherein the completion deflector is configured to direct formation fluid from the lower completion assembly into a junction tubing having a main tubing portion, a first tubing branch extending into the completion deflector, and a second tubing branch extending into the lateral bore to the fluid separator.

15. A system comprising:

a fluid separator disposed within a lateral bore of a multilateral well, wherein the fluid separator is configured to receive formation fluid from a main bore of the multilateral well and separate the formation fluid into formation water and production fluid, wherein the fluid separator is configured to output the production fluid into a lower annulus;

a lower lateral packer disposed within the lateral bore in a position downhole from the fluid separator;

an upper main bore packer disposed in the main bore in a position uphole from a junction between the main bore and the lateral bore;

a crossflow packer disposed within the lateral bore in a position uphole from the fluid separator, wherein an upper production tubing extends from the crossflow packer and through the upper main bore packer toward a surface of the multilateral well, wherein the crossflow packer and the upper main bore packer are configured to seal an upper annulus formed uphole from the fluid separator to direct flow of formation fluid from the main bore through the upper annulus, into the crossflow packer, and toward the fluid separator via a connection tubing extending between the crossflow packer and the fluid separator, and wherein the crossflow packer and the lower lateral packer are configured to seal the lower annulus about the fluid separator to direct flow of the production fluid output from the fluid separator into the crossflow packer and to the upper production tubing; and a downhole pump disposed in the lateral bore, wherein the downhole pump is configured to receive formation water from the fluid separator via a fluid conduit extending between a water outlet of the fluid separator and a water inlet of the downhole pump, wherein the downhole pump is configured to pump the formation water into a portion of the lateral bore downhole from the lower lateral packer via a lower tubing extending from the downhole pump and into the lower lateral packer.

16. The system of claim 15, wherein the fluid separator comprises:

a separator housing;

a fluid inlet formed in the separator housing, wherein the fluid inlet is disposed at an uphole end of the separator housing, wherein the fluid inlet is configured to receive the formation fluid from the main bore of the multilateral well;

an elongated fluid chamber formed in the separator housing, wherein the formation fluid is directed to flow into the elongated fluid chamber via the fluid inlet, and wherein the formation fluid is separated in response to gravity as the formation fluid flows through the elongated fluid chamber;

a water outlet formed in a bottom portion of the separator housing in a position downhole from the fluid inlet, wherein the formation water is directed to flow through the water outlet from the elongated fluid chamber; and an oil outlet formed in a top portion of the separator housing in a position downhole from the fluid inlet, wherein the production fluid is directed to flow through the oil outlet from the elongated fluid chamber.

17. The system of claim 15, wherein the lower completion assembly is disposed within the main bore in a position downhole from a completion deflector, wherein the lower completion assembly includes:

a lower main production tubing;

a plurality of completion packers disposed about the lower main production tubing and configured to isolate production zones in the main bore;

at least one screen disposed within between adjacent packers of the plurality of completion packers, wherein the at least one screen is configured to filter production fluid flowing into the lower main production tubing; and a flow control device configured to control flow of formation fluid into the lower main production tubing.

18. A method of separating oil from water downhole in a multilateral well comprising:

directing formation fluid from a main bore of a multilateral well to flow into a lateral bore of the multilateral well, wherein the formation fluid is produced via a lower completion assembly disposed in the main bore;

drawing the formation fluid into a fluid separator from the lateral bore, wherein the fluid separator is located in the lateral bore, and wherein the formation fluid at least includes formation water and production fluid;

separating the production fluid from the formation water via the fluid separator;

outputting the production fluid from the fluid separator to flow uphole toward a surface, wherein the production fluid is directed to flow uphole from the fluid separator toward the surface through a lateral annulus formed in the lateral bore and a main annulus formed in the main bore; and injecting the formation water from the fluid separator into a downhole formation disposed about the lateral bore.

19. The method of claim 18, wherein the production fluid output from the fluid separator is configured to flow into a crossflow packer, flow through production tubing extending between the crossflow packer and an upper main bore packer and continue to flow uphole toward the surface.

20. The method of claim 18, wherein the production fluid is directed to flow uphole from the fluid separator toward the surface through an inner tubing disposed within a junction tubing, and wherein the formation water is output from the fluid separator to flow through a lower lateral packer and into a lower portion of the lateral bore.

* * * * *